US008884828B2

(12) United States Patent
Kodama

(10) Patent No.: US 8,884,828 B2
(45) Date of Patent: Nov. 11, 2014

(54) MOBILE WIRELESS TERMINAL

(75) Inventor: Kenichiro Kodama, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 186 days.

(21) Appl. No.: 13/568,602

(22) Filed: Aug. 7, 2012

(65) Prior Publication Data

US 2013/0093631 A1 Apr. 18, 2013

Related U.S. Application Data

(60) Provisional application No. 61/547,775, filed on Oct. 17, 2011.

(51) Int. Cl.

| | |
|---|---|
| ***H01Q 1/24*** | (2006.01) |
| ***H01Q 1/48*** | (2006.01) |
| ***H01Q 9/04*** | (2006.01) |
| ***H01Q 21/28*** | (2006.01) |
| *H01Q 1/38* | (2006.01) |

(52) U.S. Cl.

CPC ..... *H01Q 9/0407* (2013.01); *H01Q 1/38* (2013.01); *H01Q 1/243* (2013.01); *H01Q 21/28* (2013.01); *H01Q 1/48* (2013.01)

USPC ..... 343/702; 343/848

(58) Field of Classification Search

USPC ..... 343/702, 846, 848

See application file for complete search history.

(56) References Cited

U.S. PATENT DOCUMENTS

| | | | | |
|---|---|---|---|---|
| 7,362,275 | B2 * | 4/2008 | Tu et al. | 343/702 |
| 8,060,167 | B2 * | 11/2011 | Saitou et al. | 455/575.7 |
| 2005/0239519 | A1 | 10/2005 | Saitou et al. | |
| 2007/0188391 | A1 | 8/2007 | Tu et al. | |
| 2008/0062661 | A1 | 3/2008 | Choi | |
| 2008/0143616 | A1 | 6/2008 | Tu et al. | |
| 2012/0127049 | A1 | 5/2012 | Kato | |

FOREIGN PATENT DOCUMENTS

| | | |
|---|---|---|
| JP | 2002-171111 | 6/2002 |
| JP | 2004-208219 | 7/2004 |
| JP | 2010-154507 A | 7/2010 |
| WO | WO 2011/090048 A1 | 7/2011 |

OTHER PUBLICATIONS

Extended European Search Report issued Jan. 23, 2013 in European Patent Application No. 12184529.1.

Office Action issued Nov. 29, 2013 in European Application No. 12 184 529.1-1811, 5 pages.

* cited by examiner

*Primary Examiner* — Hoang V Nguyen

(74) *Attorney, Agent, or Firm* — Oblon, Spivak, McClelland, Maier & Neustadt, L.L.P.

(57) ABSTRACT

A wireless terminal including a display device; a first conductive plate that supports the display device; a second conductive plate that supports the display device; a circuit board including a ground pattern that is connected to the first conductive plate; a radio frequency (RF) circuit mounted on the circuit board; and a first feeding unit connected to the RF circuit and disposed between the first and second conductive plates.

18 Claims, 10 Drawing Sheets

MOBILE WIRELESS TERMINAL

CROSS REFERENCE TO RELATED APPLICATION

The present application claims the benefit of the earlier filing date of U.S. Provisional Patent Application Ser. No. 61/547,775 filed on Oct. 17, 2011, the entire contents of which is incorporated herein by reference.

BACKGROUND

1. Field of the Disclosure

The present disclosure relates to mobile wireless terminals, such as mobile phone terminals and tablet terminals, and antenna devices mounted in the mobile wireless terminals.

2. Description of Related Art

Heretofore, dipole antennas have been known as an antenna device for a mobile wireless terminal. Such dipole antennas have an antenna element having a length of approximately a quarter of the wavelength of the transmitted/received radio waves (see Japanese Unexamined Patent Application Publication No. 2002-171111). This technology achieves a dipole antenna by feeding power between an antenna element and a conductor that serves as a ground plate for the antenna element. A shield provided for a casing, a shield that covers a circuit component, a ground pattern of a printed board having a circuit component disposed on the printed board, or the like is used as a ground plate. Accordingly, the length of the antenna element can be reduced by one-half without changing the electrical size that is required for the dipole antenna.

A technology has been proposed for a mobile wireless terminal, such as a clamshell-shaped or slidable mobile telephone handset having first and second casings that are movably coupled to each other. In this mobile wireless terminal, power is fed from a ground plate (conductor) in the first casing to a ground plate in the second casing, whereby the entire mobile wireless terminal is caused to serve as a dipole antenna (see Japanese Unexamined Patent Application Publication No. 2004-208219). With this conventional technology, a dedicated antenna element as described in Japanese Unexamined Patent Application Publication No. 2002-171111 can be removed.

SUMMARY

There has been a problem in that the technology described in Japanese Unexamined Patent Application Publication No. 2004-208219 can be used only for a terminal having two separate casings, such as a clamshell-shaped or slidable terminal. There has been another problem in that the terminal can be used only when the first and second casings are in the open position, because the performance of the antenna is significantly degraded when the first and second casings are in the closed position.

The mainstream form of mobile wireless terminals, which are typified by mobile telephone handsets, has shifted from so-called straight-type terminals having a single casing that houses ten keys and a display section, to terminals having two casings that are coupled to each other so as to be openable/closable, such as clamshell-shaped or slidable terminals.

Mobile wireless terminals, such as so-called smart phones, have rapidly become popular these days. Such mobile wireless terminals have a single casing which includes a display device having a display screen that has a touch function. This trend represents a return to straight-type terminals from the viewpoint of the form of terminals.

With consideration of such a background, the inventor of this application has recognized that a desired function of a dipole antenna needs to be achieved without using a dedicated antenna unit even in a mobile wireless terminal that has a single casing.

A mobile wireless terminal according to an embodiment of the present disclosure includes a display device; a first conductive plate that supports the display device; a second conductive plate that supports the display device; a circuit board including a ground pattern that is connected to the first conductive plate; a radio frequency (RF) circuit mounted on the circuit board; and a first feeding unit connected to the RF circuit and disposed between the first and second conductive plates.

More specifically, a straight-type mobile wireless terminal such as a smart phone has a single casing that has an internal configuration divided into two parts. This configuration enables the above-described conventional technology to be used even in a straight-type terminal. In addition, in the case of requiring multiple antennas as in LTE, for example, the number of necessary antenna units can be decreased. Accordingly, this configuration can contribute to a reduction in the dimensions, the thickness, and the cost of the mobile wireless terminal.

DETAILED DESCRIPTION

Embodiments of the present disclosure will be described in detail below with reference to the drawings.

Figure 1A:
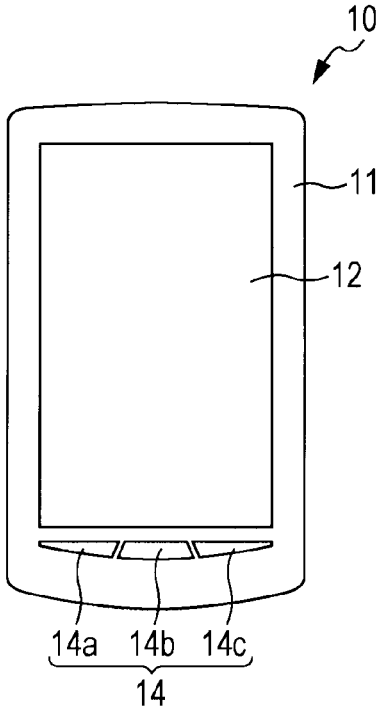
FIGS. 1A and 1B are diagrams illustrating exemplary forms of mobile wireless terminals to which the present disclosure is applied.

FIG. 1 illustrates exemplary forms of mobile wireless terminals to which the present disclosure is applied. FIG. 1A is a front view of a mobile wireless terminal 10, such as a so-called smart phone. The mobile wireless terminal 10 includes a single casing 11, a display device 12 of planar shape which has a display screen extending over substantially the entire region of the surface of the casing 11, and an operation section 14 constituted by multiple hard keys 14*a*, 14*b*, and 14*c* which are disposed below the display screen. The display device 12 according to the present embodiments is assumed to be a liquid crystal display (LCD), and also serves as a touch panel having a touching region which overlies a display region of the display screen. However, the display device 12 is not necessarily limited to an LCD.

Figure 1B:
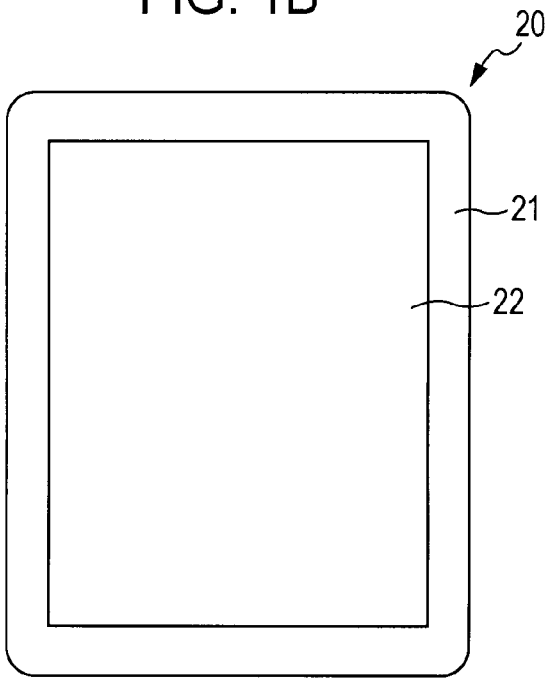

FIG. 1B is a front view illustrating a mobile wireless terminal 20, which is a so-called tablet terminal. A tablet terminal typically has a display device 22 that has a larger screen than that of a smart phone. That is, the mobile wireless terminal 20 includes a single larger casing 21 and the display device 22 having a larger display screen that extends over substantially the entire region of the surface of the casing 21. In this example, the illustrated tablet terminal has no hard keys, such as those included in the operation section 14. However, the tablet terminal may have such hard keys.

Hereinafter, the term "mobile wireless terminals" encompasses a smart phone and a tablet terminal, and also encompasses any other terminals that have a similar configuration, unless otherwise specified.

Figure 2:
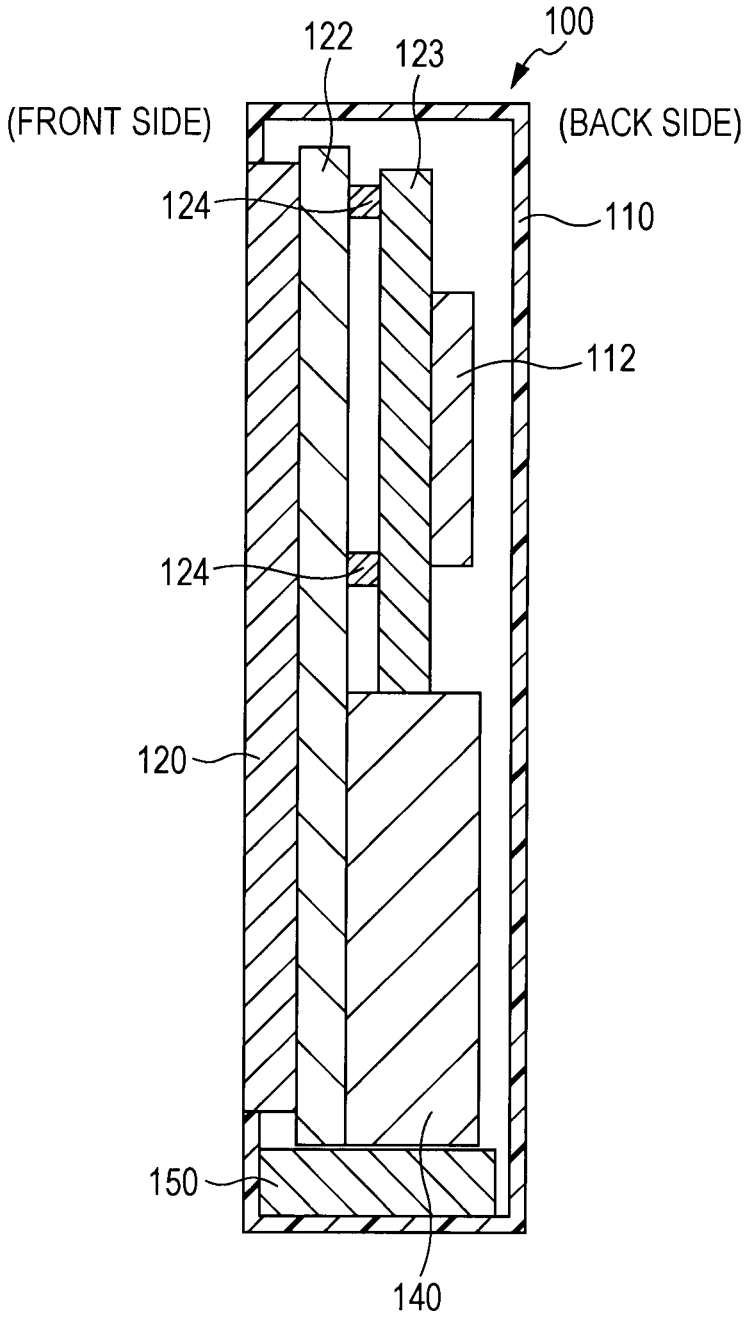
FIG. 2 is a side view illustrating a general internal configuration of a mobile wireless terminal to which embodiments of the present disclosure are applied.

FIG. 2 is a side view illustrating a general internal configuration of a mobile wireless terminal 100 to which the embodiments of the present disclosure are applied. In FIG. 2, the left side of the mobile wireless terminal 100 corresponds to the front side of the mobile wireless terminal 100, and the right side corresponds to the back side. The mobile wireless terminal 100 includes a casing 110 that is formed of a dielectric material, such as a resin. In the casing 110, an LCD 120 which serves as a display device, an LCD frame 122 which serves as a supporting frame for supporting the LCD 120, a printed circuit board (PCB) 123, a battery 140, and an antenna 150 are disposed.

The LCD frame 122 is typically a conductive plate that is formed of a conductive, rigid material, which is a metal in this example. For example, the LCD frame 122 is a metal plate formed of stainless steel (Steel Use Stainless) SUS.

The PCB 123 is a so-called half board that has such a size that the PCB 123 is housed in a substantially upper-half region inside the casing 110. An RF circuit 112 and a baseband circuit (not illustrated) are mounted on the PCB 123. The RF circuit 112 is a high frequency circuit section for performing wireless communication (transmission/reception). The baseband circuit processes a baseband (BB) signal. More specifically, various electronic parts for implementing the above-described circuits are mounted on the PCB 123.

The battery 140 is connected to the electric circuits on the PCB 123 via contact members, such as conductive springs. A GND pattern (not illustrated) of the PCB 123 is connected to the LCD frame 122 via electrically connecting members 124, such as springs or clips, to enhance the GND.

In the example illustrated in FIG. 2, the antenna 150 is disposed in the lowest portion of the mobile wireless terminal 100. The antenna 150 is constituted by an antenna unit that includes an antenna element which forms a radiating element of the antenna 150. The antenna 150 is connected to the RF circuit 112 via an RF signal line or the like.

Figure 3A:
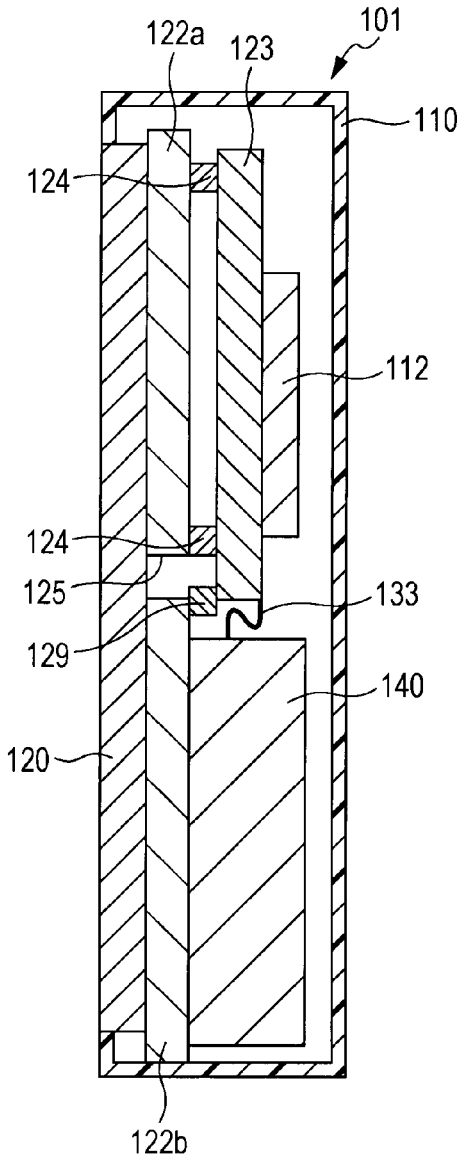
FIGS. 3A and 3B are diagrams illustrating an exemplary configuration of a mobile wireless terminal according to a first embodiment of the present disclosure.
Figure 3B:
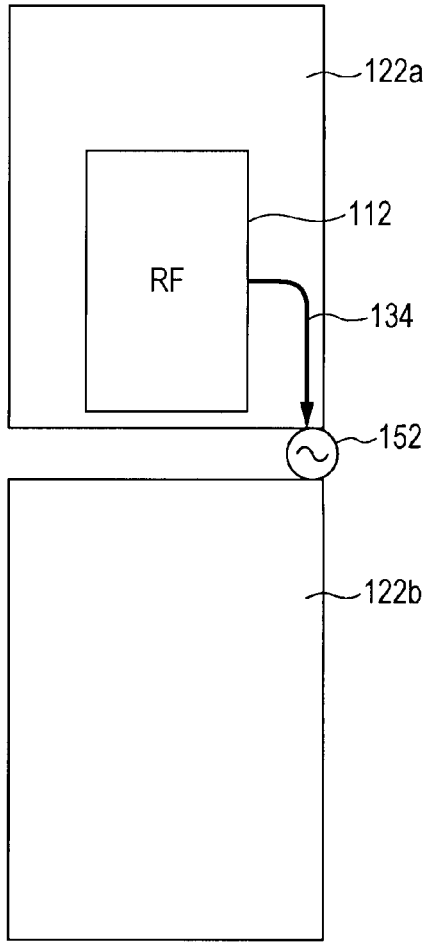

FIGS. 3A and 3B illustrate an exemplary configuration of a mobile wireless terminal 101 according to a first embodiment of the present disclosure. The mobile wireless terminal 101 is an embodiment obtained by applying the present disclosure to the mobile wireless terminal 100 illustrated in FIG. 2. In FIGS. 3A and 3B, components that are similar to those illustrated in FIG. 2 are denoted by the same reference numerals. FIG. 3A is a side view illustrating a general internal configuration of the mobile wireless terminal 101.

As illustrated in FIG. 3A, the LCD frame 122 is divided into an upper conductive plate 122*a* disposed in an upper-half portion inside the casing 110, and a lower conductive plate 122*b* disposed in a lower-half portion inside the casing 110. The upper conductive plate 122*a* and the lower conductive plate 122*b* are disposed on the back side of the LCD 120 with a slit 125 interposed therebetween. That is, the upper conductive plate 122*a* and the lower conductive plate 122*b* are represented by a first conductive plate and a second conductive plate, respectively, that constitute a supporting frame for supporting the LCD 120 and that are separated from each other. Each of the upper conductive plate 122*a* and the lower conductive plate 122*b* in this example has a length in the longitudinal direction which is on the order of a quarter of the wavelength of the usable frequency. Each of the upper conductive plate 122*a* and the lower conductive plate 122*b* is not necessarily a solid plate, and may have a configuration in which the plate has holes or hollow portions therein.

The upper conductive plate 122*a* and the lower conductive plate 122*b* may have a configuration in which these plates are simply separated from each other. However, it is desirable that these plates, which are to serve as a supporting frame for supporting the LCD 120 securely, be joined to each other in such a state that the plates remain insulated from each other. FIG. 4 includes diagrams illustrating exemplary structures for joining the upper conductive plate 122*a* and the lower conductive plate 122*b* to each other, according to the first embodiment of the present disclosure.

Figure 4A:
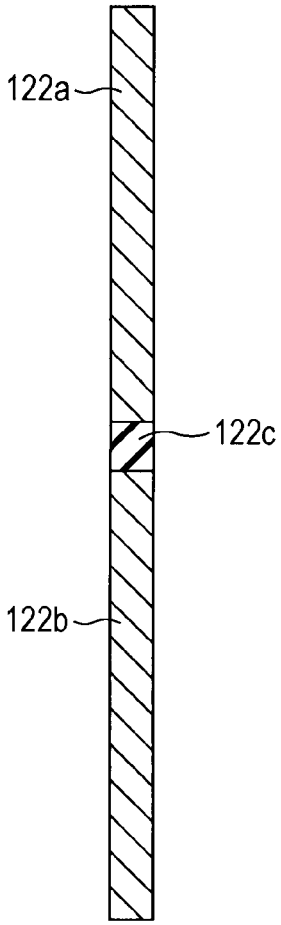
FIGS. 4A, 4B, and 4C are diagrams illustrating exemplary structures for joining an upper conductive plate and a lower conductive plate to each other, according to the first embodiment of the present disclosure.
Figure 4B:
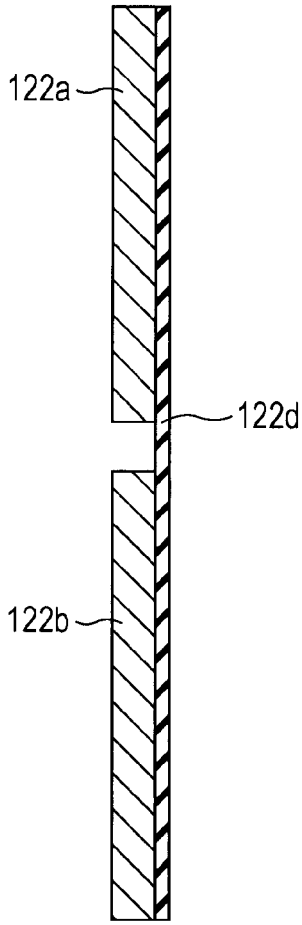
Figure 4C:
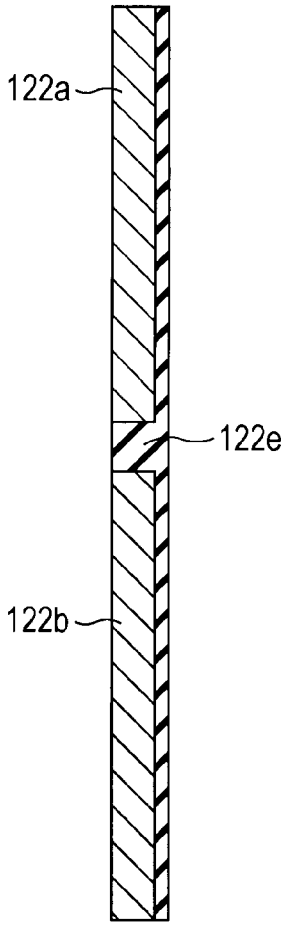

FIG. 4A illustrates an example in which the upper conductive plate 122*a* and the lower conductive plate 122*b* are joined with the gap therebetween filled with a bonding member 122*c* composed of a non-conductive (insulative), rigid material (for example, an adhesive). Instead, as illustrated in FIG. 4B, the upper conductive plate 122*a* and the lower conductive plate 122*b* may be reinforced with a supporting plate 122*d* which continuously extends along the backs thereof. The supporting plate 122*d* is composed of a non-conductive, rigid material. Instead, as illustrated in FIG. 4C, a supporting plate 122*e* may be used which has a configuration that is a combination of the configurations in FIGS. 4A and 4B.

Referring back to FIG. 3A, since the RF circuit 112 is mounted on the PCB 123 which is disposed on the upper side of the casing 110, power is fed from the RF circuit 112 to the lower conductive plate 122*b* of the LCD frame 122 via an RF signal line (such as a strip line, a flexible cable, or a fine coaxial line) by using an electrically connecting member 129 such as a spring. The battery 140, and BB/RF signals and the like of other circuit boards and the like (if any) are connected to the PCB 123 via a signal line 133, such as a flexible cable or a fine coaxial line. The battery 140 and such circuit boards are disposed in a lower-half region of the casing 110.

With the above-described configuration, a mobile wireless terminal can be achieved which has an upper portion and a lower portion thereinside that are electrically separated from each other although the mobile wireless terminal has the appearance of being a straight-type terminal.

FIG. 3B is an equivalent block diagram illustrating a configuration of an antenna of the mobile wireless terminal 101. From the RF circuit 112 via an RF signal line 134, such as a flexible cable or a fine coaxial line, at a feeding unit (feeding point) 152 that is disposed between the upper conductive plate 122*a* and the lower conductive plate 122*b*, power is fed from the upper conductive plate 122*a* to the lower conductive plate 122*b*. This configuration enables the upper conductive plate 122*a* and the lower conductive plate 122*b* to serve as a dipole antenna. The lower conductive plate 122*b* is used as a radiating element of the antenna, and the upper conductive plate 122*a* is used as a ground plate (GND) for the antenna. (The upper conductive plate 122*a* serving as the ground plate for the antenna also serves as a radiating element of the antenna.)

According to the present embodiment, the antenna 150 which is present in the lower portion in the configuration of FIG. 2 can physically be removed. As a result, the dimensions, the thickness, and the cost of the mobile wireless terminal can be reduced. In addition, the present antenna device can be configured by using the existing internal structure of the mobile wireless terminal. With such a configuration, the number of parts and the cost of the mobile wireless terminal can be reduced.

Now, a second embodiment of the present disclosure will be described.

Figure 5:
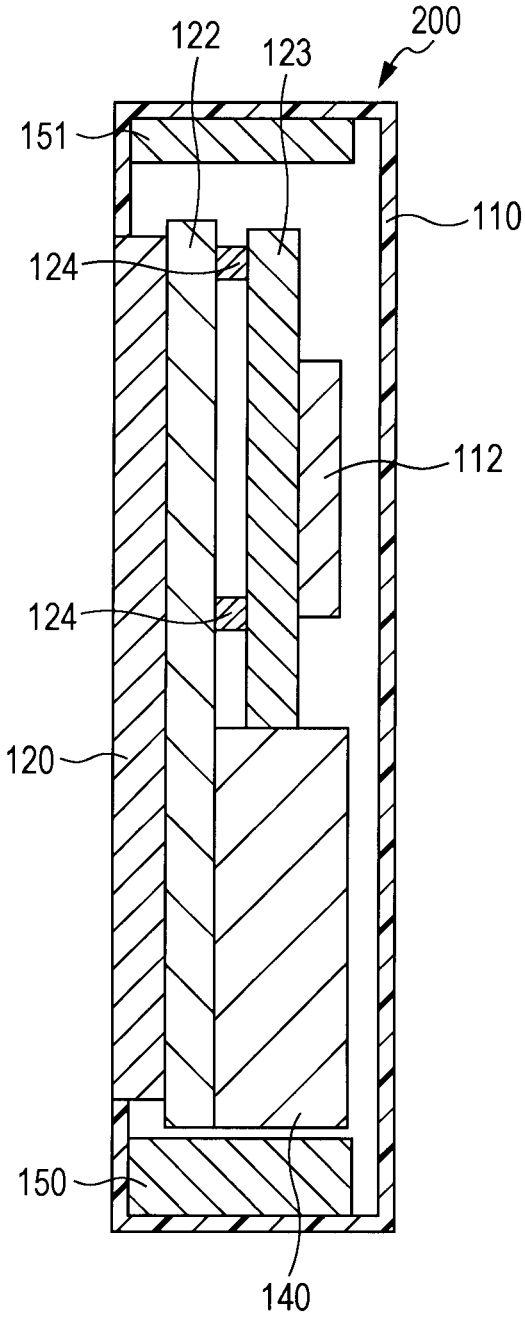
FIG. 5 is a side view illustrating a general configuration of a mobile wireless terminal to which a second embodiment of the present disclosure is applied.

FIG. 5 is a side view illustrating a general configuration of a mobile wireless terminal 200 to which the second embodiment of the present disclosure is applied. In FIG. 5, components that are similar to those illustrated in FIG. 2 are denoted by the same reference numerals, and repeated description will be avoided.

The mobile wireless terminal 200 is a smart phone that is compatible with LTE (Long Term Evolution) which is one of the high-speed data communication specifications for mobile phones. LTE employs a communication system called MIMO which uses multiple antennas for transmission and reception to achieve high-speed data communication. A mobile wireless terminal employing MIMO typically uses two antennas. In the example in FIG. 5, the first antenna 150 is mounted in the lower portion of the casing, and a second antenna 151 is mounted in the upper portion of the casing.

Figure 6A:
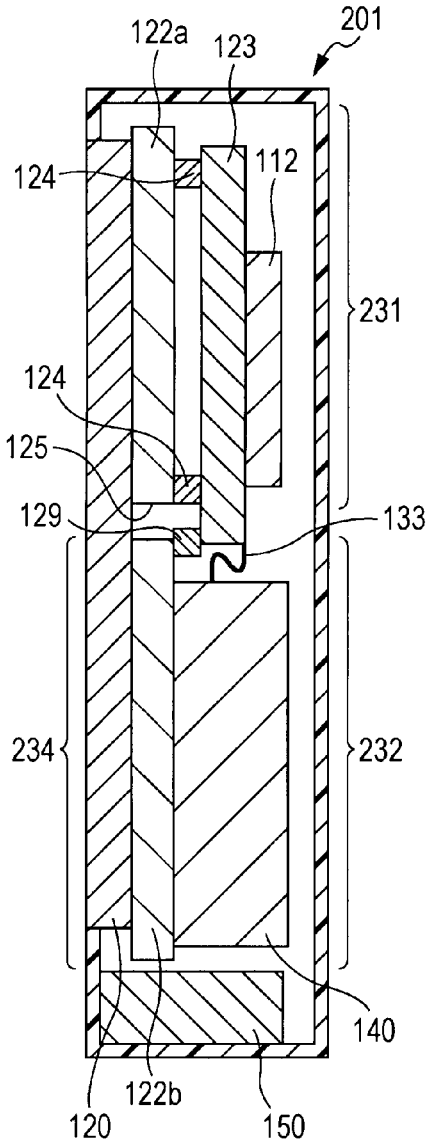
FIGS. 6A and 6B are diagrams illustrating an exemplary configuration of a mobile wireless terminal according to the second embodiment of the present disclosure.
Figure 6B:
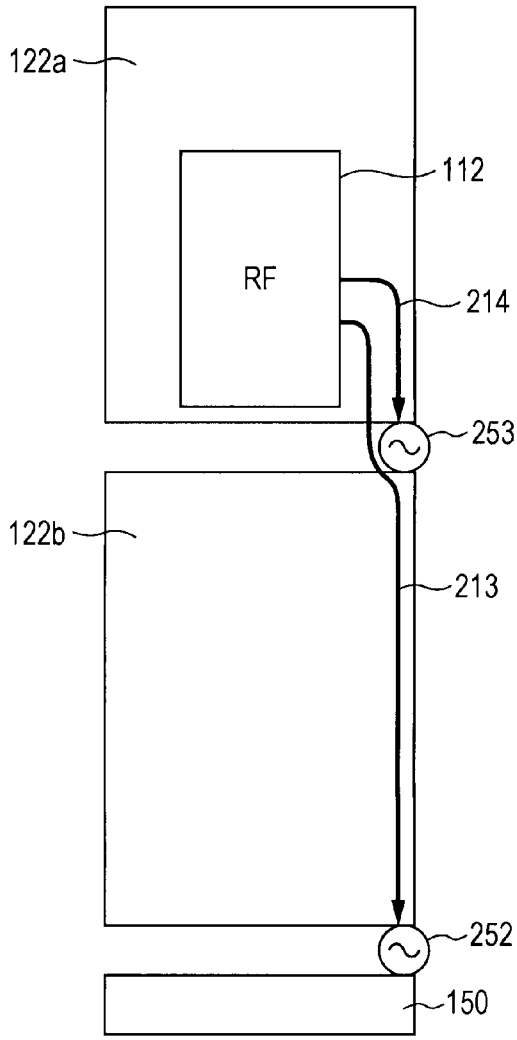

FIGS. 6A and 6B illustrate an exemplary configuration of a mobile wireless terminal 201 according to the second embodiment of the present disclosure. In FIG. 6, components that are similar to those illustrated in FIGS. 3A and 3B are denoted by the same reference numerals, and repeated description will be avoided. The mobile wireless terminal 201 is an embodiment obtained by applying the present disclosure to the mobile wireless terminal 200 illustrated in FIG. 5. FIG. 6A is a side view illustrating a general internal configuration of the mobile wireless terminal 201.

As illustrated in FIG. 6A, the LCD frame 122 is divided into the upper conductive plate 122*a* and the lower conductive plate 122*b*, similarly to the first embodiment. In this configuration, the antenna 150 (antenna unit) and the conductive plate 122*b* serve as a first dipole antenna, and the first and second conductive plates 122*a* and 122*b* serve as a second dipole antenna. More specifically, the lower conductive plate 122*b* serves as a radiating element 232 of the second antenna, and the upper conductive plate 122*a* serves as a ground plate 231 for the second antenna. The lower conductive plate 122*b* also serves as a ground plate 234 for the first antenna. As apparent when FIG. 6 is compared with FIG. 5, the upper second antenna 151 has been physically removed. As a result, the dimensions, the thickness, and the cost of the mobile wireless terminal can be reduced.

FIG. 6B is an equivalent block diagram illustrating a configuration of the antennas of the mobile wireless terminal 201. From the RF circuit 112 via an RF signal line 213, at a feeding unit 252 that is disposed between the conductive plate 122*b* and the first antenna 150, power is fed to the first antenna 150. From an RF circuit 112 via an RF signal line 214, at a feeding unit 253 that is disposed between the upper conductive plate 122*a* and the lower conductive plate 122*b*, power is fed from the upper conductive plate 122*a* to the lower conductive plate 122*b*. This configuration enables the lower conductive plate 122*b* to be used as the radiating element 232 of the second antenna, and enables the upper conductive plate 122*a* to serve as the ground plate 231 for the second antenna. The lower conductive plate 122*b* is also used as the ground plate 234 for the first antenna 150.

An exemplary modification of the second embodiment may be employed in which via the RF signal line 214, at the feeding unit 253 that is disposed between the upper conductive plate 122*a* and the lower conductive plate 122*b*, power is fed from the lower conductive plate 122*b* to the upper conductive plate 122*a*. This configuration enables the upper conductive plate 122*a* to be used as the radiating element 232 of the second antenna, and enables the lower conductive plate 122*b* to serve as the ground plate 231 for the second antenna.

Antenna characteristics which both of the antennas exhibit in MIMO are ideally required to be equivalent to each other. On the other hand, to avoid a problem such as a decrease in communication speed, the antenna characteristics are required to have a low value (coefficient) of an index that is called correlation of antennas (that is, to have a low degree of correlation).

Figure 7:
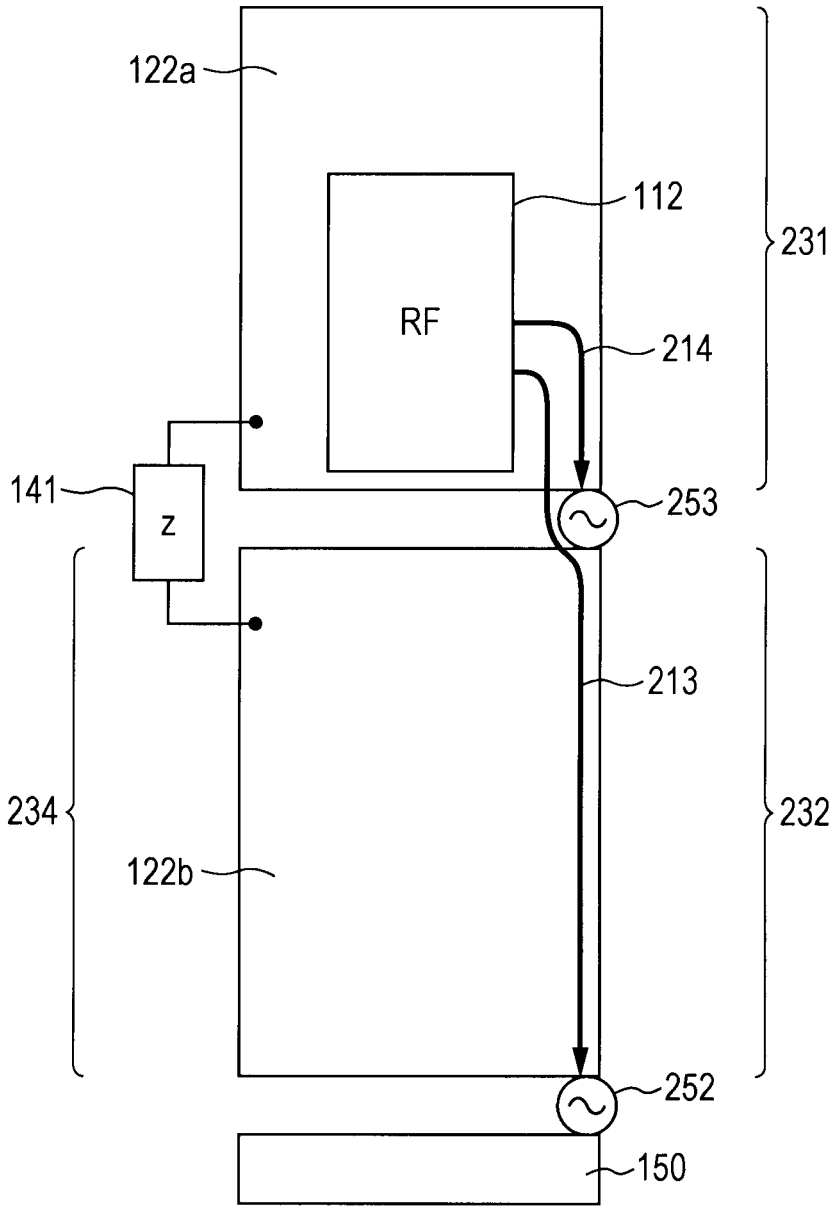
FIG. 7 is a diagram illustrating a first exemplary modification of the second embodiment of the present disclosure.

FIG. 7 illustrates a first exemplary modification of the second embodiment. In a configuration of antennas illustrated in FIG. 7, the second antenna 151 for LTE in FIG. 5 has been physically removed, and the upper and lower conductive plates 122*a* and 122*b* are connected via a reactive element 141 having an impedance z. The reactive element 141 may be constituted by an inductor which is an inductive element, a capacitor which is a capacitive element, or a combination of these elements. By adjusting the impedance z, the phases of the currents which flow in the upper and lower conductive plates 122*a* and 122*b* can be controlled in accordance with the first antenna 150. Controlling of the current phases causes a change in the radiation pattern of the first antenna 150. Through such a change, a decrease in the degree of correlation between the first antenna and the second antenna, which is required for LTE, can be achieved. When the impedance z is to be adjusted, an impedance z is sought which minimizes the degree of correlation between both of the antennas. The RF signal lines are connected to the feeding units via matching circuits (not illustrated). In the case where the adjustment of the impedance z needs to cause a change in the matching states of the matching circuits, the matching circuits may be adjusted.

Figure 8:
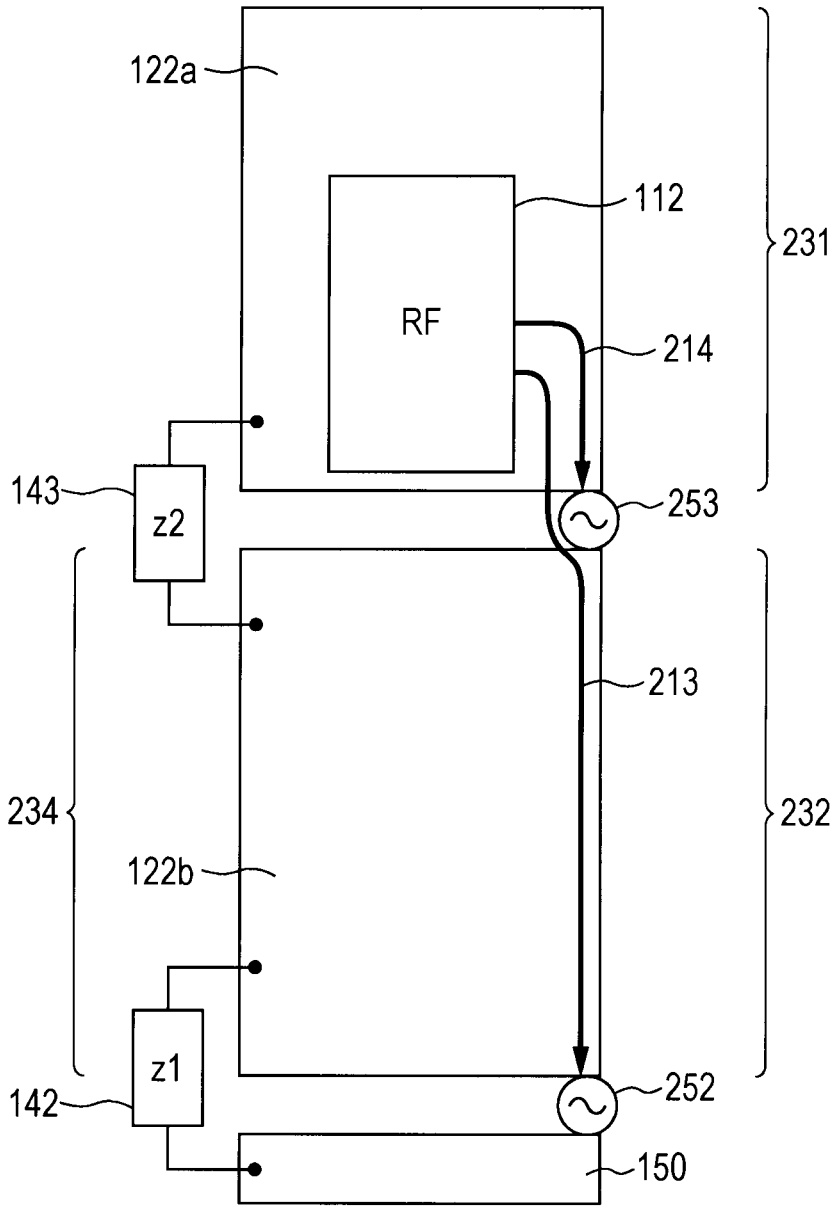
FIG. 8 is a diagram illustrating a second exemplary modification of the second embodiment of the present disclosure.

FIG. 8 illustrates a second exemplary modification of the second embodiment. In a configuration illustrated in FIG. 8, a reactive element 143, which is similar to the reactive element 141 illustrated in FIG. 7 but has an impedance z2, is connected between the upper and lower conductive plates 122*a* and 122*b*. A reactive element 142 having an impedance z1 is also connected between the first antenna 150 and the lower conductive plate 122*b*. This configuration enables the phases of the currents which flow in the ground plates, to be controlled in accordance with the respective antennas. As a result, the radiation patterns of the first antenna and the second antenna are optimized, whereby the degree of correlation between the two antennas is decreased, and also an adverse effect on the human body can be reduced and a beam can be directed to a base station.

Figure 9:
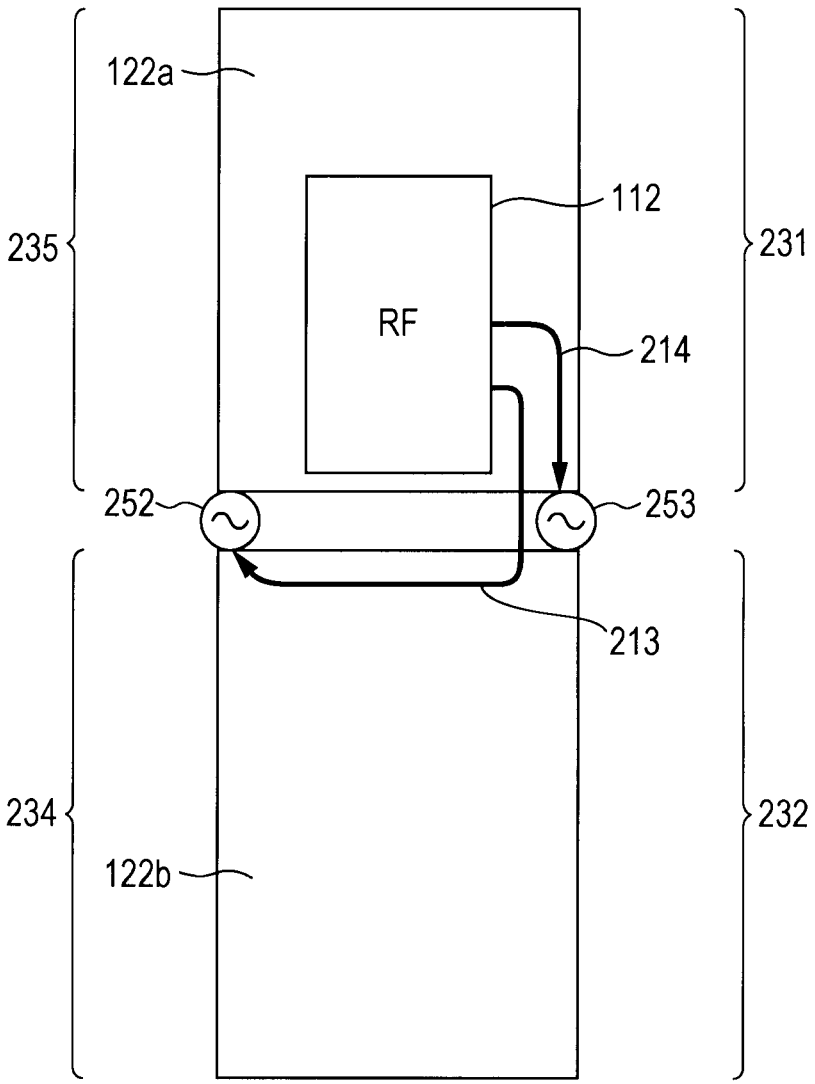
FIG. 9 is a diagram illustrating an exemplary configuration of antenna devices of a mobile wireless terminal according to a third embodiment of the present disclosure.

FIG. 9 illustrates an exemplary configuration of antenna devices of a mobile wireless terminal 301 according to a third embodiment of the present disclosure. In FIG. 9, components that are similar to those illustrated in FIG. 7 are denoted by the same reference numerals, and repeated description will be avoided.

The mobile wireless terminal 301 has a configuration in which both of the first and second antennas for LTE are constituted by the upper and lower conductive plates 122*a* and 122*b*. The feeding unit 252 for the first antenna is disposed near the left end portion of the boundary between the conductive plates, and the feeding unit 253 for the second antenna, near the right end portion. Signals flow from the RF circuit 212 mounted on the PCB, as illustrated in FIG. 9. In the first antenna, at the feeding unit 252 via the RF signal line 213 that leads to the lower conductive plate side, power is fed from the lower conductive plate 122*b* to the upper conductive plate 122*a*. In the second antenna, from the RF circuit 212 via the RF signal line 214, at the feeding unit 253, power is fed from the upper conductive plate 122*a* to the lower conductive plate 122*b*.

This configuration causes the upper conductive plate 122*a* to serve as (a radiating element of) the first antenna 235 as well as to serve as the ground plate 231 for the second antenna. The configuration also causes the lower conductive plate 122*b* to serve as the ground plate 234 for the first antenna as well as to serve as (the radiating element of) the second antenna 232. The configuration enables the two antenna units for LTE to be physically removed.

Figure 10A:
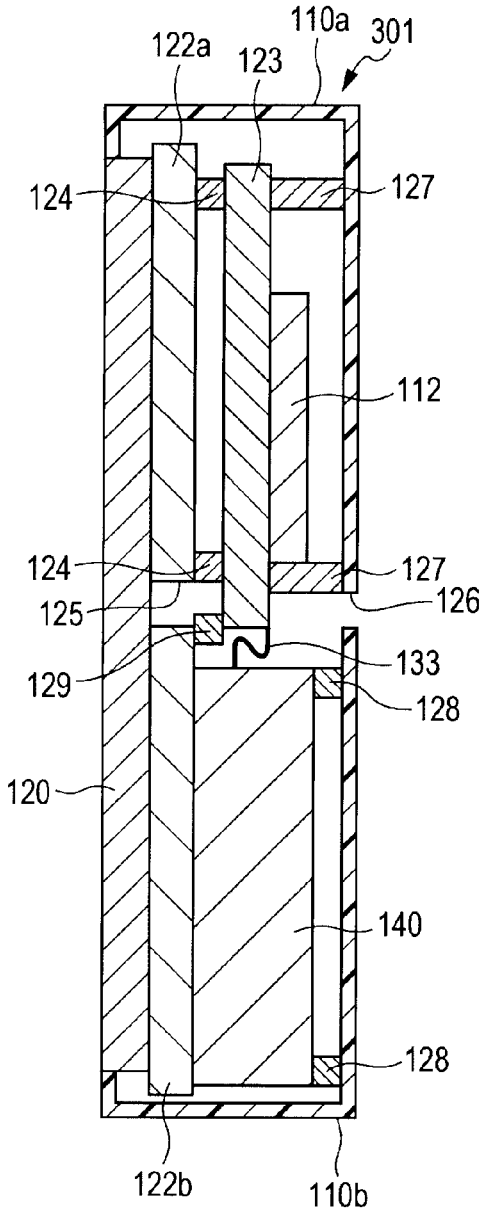
FIGS. 10A and 10B are diagrams illustrating an exemplary configuration of the mobile wireless terminal according to a fourth embodiment of the present disclosure.
Figure 10B:
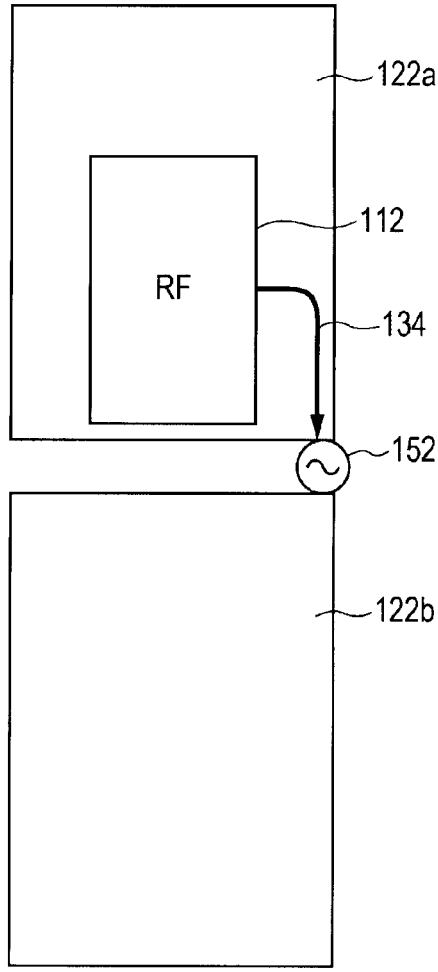

FIGS. 10A and 10B illustrate an exemplary configuration of the mobile wireless terminal 301 according to a fourth embodiment of the present disclosure. In FIGS. 10A and 10B, components that are similar to those illustrated in FIGS. 3A and 3B are denoted by the same reference numerals, and repeated description will be avoided.

Typically, casings of many mobile wireless terminals are formed of a non-conductive material such as a resin. However, a casing may be formed of a metal due to a requirement in, for example, the design of the appearance. In the case of employing such a metal casing, the above-described antenna device that is constituted by the upper and lower conductive plates may not function properly.

To address the above issue, the present embodiment employs a configuration in which, in the case where a casing is formed of a conductive material such as a metal, the casing 110 is also divided into an upper casing part 110*a* and a lower casing part 110*b* that correspond to the upper conductive plate 122*a* and the lower conductive plate 122*b*, respectively. The upper casing part 110*a* and the lower casing part 110*b* are electrically insulated from each other. The upper casing part 110*a* is electrically connected to the GND pattern of the PCB 123 and to the upper conductive plate 122*a* via electrically connecting members 127 such as springs. Similarly, the lower casing part 110*b* is electrically connected to the lower conductive plate 122*b* via electrically connecting members 128 such as springs. An antenna device of the mobile wireless terminal 301 illustrated in FIG. 10B has the same electrical configuration as that illustrated in FIG. 3B.

The upper casing part 110*a* and the lower casing part 110*b* are practically joined together with a slit 126 therebetween filled with resin or the like, forming an integral part.

As described above, in the description of the embodiment of the present disclosure, a mobile wireless terminal includes (1) a display device; a first conductive plate that supports the display device; a second conductive plate that supports the display device; a circuit board including a ground pattern that is connected to the first conductive plate; a radio frequency (RF) circuit mounted on the circuit board; and a first feeding unit connected to the RF circuit and disposed between the first and second conductive plates.

(2) The wireless terminal of (1), wherein the first conductive plate is not in direct contact with the second conductive plate.

(3) The wireless terminal of (1) or (2), wherein the first conductive plate and the second conductive plate are attached via a non-conductive rigid material.

(4) The wireless terminal of any of (1) to (3), wherein the display device and the first and second conductive plates each have a planar shape.

(5) The wireless terminal of (4), wherein the display device and the first and second conductive plates are disposed such that planar surfaces of the display device and the first and second conductive plates are parallel.

(6) The wireless terminal of any of (1) to (5), further comprising: a plurality of electrically connecting members disposed between the circuit board and the first and second conductive plates that connect the RF circuit to the first and second conductive plates.

(7) The wireless terminal of any of (1) to (6), wherein the RF circuit feeds power from the first conductive plate to the second conductive plate via the first feeding unit.

(8) The wireless terminal of any of (1) to (7), further comprising: an antenna unit including an antenna radiating element.

(9) The wireless terminal of (8), further comprising: a second feeding unit connected to the RF circuit and disposed between the second conductive plate and the antenna unit.

(10) The wireless terminal of (9), wherein the RF circuit feeds power from the first conductive plate to the second conductive plate via the first feeding unit.

(11) The wireless terminal of (9) or (10), wherein the RF circuit feeds power from the second conductive plate to the antenna unit via the second feeding unit.

(12) The wireless terminal of any of (1) to (11), further comprising: a reactive element connecting the first and second conductive plates.

(13) The wireless terminal of any of (8) to (12), further comprising: a reactive element connecting the second conductive plate and the antenna unit.

(14) The wireless terminal of any of (1) to (13), further comprising: a second feeding unit connected to the RF circuit and disposed between the first and second conductive plates.

(15) The wireless terminal of (14), wherein the RF circuit feeds power from the first conductive plate to the second conductive plate via the first feeding unit.

(16) The wireless terminal of (14) or (15), wherein the RF circuit feeds power from the second conductive plate to the first conductive plate via the second feeding unit.

(17) The wireless terminal of any of (1) to (16), further comprising: a housing including a first casing part and a second casing part that are electrically insulated from one another.

(18) The wireless terminal of (17), wherein the first casing part is electrically connected to the ground pattern of the circuit board and the first conductive plate.

(19) The wireless terminal of (17) or (18), wherein the second casing part is electrically connected to second conductive plate.

(20) The wireless terminal of any of (17) to (19), wherein the first casing part and the second casing part are attached via a non-conductive rigid material.

In the description, the mobile wireless terminal includes a single conductive casing, wherein the casing is divided into first and second casing parts that correspond to the respective first and second conductive plates, the first casing part is electrically connected to the first conductive plate, and the second casing part is electrically connected to the second conductive plate.

As described above, preferable embodiments of the present disclosure have been described. Various modifications and changes can be made in addition to the above-described embodiments. That is, it is naturally understood by those skilled in the art that various modifications, combinations, and other embodiments may be made depending on a design or other elements as long as they fall within the scope of the claims and in the scope of equivalents to the claims.

For example, a mobile phone system is taken as an example of the wireless system of the mobile wireless terminal. However, the mobile wireless terminal is applicable to other wireless systems, such as a wireless LAN or Bluetooth™ system. The dimensions of the upper conductive plate and the lower conductive plate are basically determined in accordance with the size of the display device. However, the dimensions may be adjusted within an allowable range according to the usable frequency.

The invention claimed is:

1. A wireless terminal comprising:
a first conductive plate;
a second conductive plate;
a circuit board including a ground pattern that is connected to the first conductive plate;
a radio frequency (RF) circuit mounted on the circuit board;
a first feed connected to the RF circuit and disposed between the first and second conductive plates;
an antenna including an antenna radiating element; and
a second feed connected to the RF circuit and disposed between the second conductive plate and the antenna.

2. The wireless terminal of claim 1, wherein
the first conductive plate is not in direct contact with the second conductive plate.

3. The wireless terminal of claim 1, wherein
the first conductive plate and the second conductive plate are attached via a non-conductive rigid material.

4. The wireless terminal of claim 1, further comprising:
a display device, wherein
the first and second conductive plates support the display device, and
the display device and the first and second conductive plates each have a planar shape.

5. The wireless terminal of claim 4, wherein
the display device and the first and second conductive plates are disposed such that planar surfaces of the display device and the first and second conductive plates are parallel.

6. The wireless terminal of claim 1, further comprising:
a plurality of electrically connecting members disposed between the circuit board and the first and second conductive plates that connect the RF circuit to the first and second conductive plates.

7. The wireless terminal of claim 1, wherein
the RF circuit feeds power from the first conductive plate to the second conductive plate via the first feed.

8. The wireless terminal of claim 1, wherein
the RF circuit feeds power from the first conductive plate to the second conductive plate via the first feed.

9. The wireless terminal of claim 1, wherein
the RF circuit feeds power from the second conductive plate to the antenna via the second feed.

10. The wireless terminal of claim 1, further comprising:
a reactive element connecting the first and second conductive plates.

11. The wireless terminal of claim 1, further comprising:
a reactive element connecting the second conductive plate and the antenna.

12. The wireless terminal of claim 1, further comprising:
a housing including a first casing part and a second casing part that are electrically insulated from one another.

13. The wireless terminal of claim 12, wherein
the first casing part is electrically connected to the ground pattern of the circuit board and the first conductive plate.

14. The wireless terminal of claim 12, wherein
the second casing part is electrically connected to second conductive plate.

15. The wireless terminal of claim 12, wherein
the first casing part and the second casing part are attached via a non-conductive rigid material.

16. A wireless terminal, comprising:
a first conductive plate;
a second conductive plate;
a circuit board including a ground pattern that is connected to the first conductive plate;
a radio frequency (RF) circuit mounted on the circuit board;
a first feed connected to the RF circuit and disposed between the first and second conductive plates; and
a second feed connected to the RF circuit and disposed between the first and second conductive plates.

17. The wireless terminal of claim 16, wherein
the RF circuit feeds power from the first conductive plate to the second conductive plate via the first feed.

18. The wireless terminal of claim 16, wherein
the RF circuit feeds power from the second conductive plate to the first conductive plate via the second feed.

* * * * *